US007832202B2

(12) United States Patent
Kojima et al.

(10) Patent No.: US 7,832,202 B2
(45) Date of Patent: Nov. 16, 2010

(54) EXHAUST GAS PURIFICATION DEVICE FOR INTERNAL COMBUSTION ENGINE

(75) Inventors: Kazuo Kojima, Nagoya (JP); Jun Kawamura, Chita-gun (JP); Masumi Kinugawa, Okazaki (JP)

(73) Assignee: Denso Corporation, Kariya, Aichi-Pref. (JP)

( * ) Notice: Subject to any disclaimer, the term of this patent is extended or adjusted under 35 U.S.C. 154(b) by 796 days.

(21) Appl. No.: 11/826,027

(22) Filed: Jul. 11, 2007

(65) Prior Publication Data

US 2008/0010977 A1 Jan. 17, 2008

(30) Foreign Application Priority Data

Jul. 13, 2006 (JP) ..... 2006-192461

(51) Int. Cl.
*F01N 3/00* (2006.01)
*F01N 3/10* (2006.01)

(52) U.S. Cl. ..... 60/295; 60/277; 60/285; 60/286; 60/301; 60/303

(58) Field of Classification Search ..... 60/277, 60/285, 286, 295, 300, 301, 303
See application file for complete search history.

(56) References Cited

U.S. PATENT DOCUMENTS

| | | | | |
|---|---|---|---|---|
| 6,244,046 | B1 | 6/2001 | Yamashita | |
| 2002/0023432 | A1 * | 2/2002 | Ishizuka et al. | 60/285 |
| 2004/0163381 | A1 * | 8/2004 | Shirakawa et al. | 60/285 |

FOREIGN PATENT DOCUMENTS

| | | |
|---|---|---|
| JP | 2000-34946 | 8/2001 |

* cited by examiner

*Primary Examiner*—Thomas E Denion
*Assistant Examiner*—Audrey Klasterka
(74) *Attorney, Agent, or Firm*—Nixon & Vanderhye PC

(57) ABSTRACT

An exhaust gas purification device senses an air-fuel ratio of exhaust gas flowing into a catalyst and performs rich purge control for supplying fuel for reduction to the catalyst. The device calculates a total reducing agent amount consumed for the reduction during the rich purge control based on the air-fuel ratio and a fresh air amount as of the rich purge control. The device sets a specified air-fuel ratio state for controlling the air-fuel ratio in a certain range enabling more precise measurement of the air-fuel ratio than in the rich purge control. The device corrects the total reducing agent amount based on a difference between an injection amount command value as of the rich purge control and the injection amount command value in the specified air-fuel ratio state and the air-fuel ratio sensed in the specified air-fuel ratio state.

12 Claims, 6 Drawing Sheets

EXHAUST GAS PURIFICATION DEVICE FOR INTERNAL COMBUSTION ENGINE

CROSS REFERENCE TO RELATED APPLICATION

This application is based on and incorporates herein by reference Japanese Patent Application No. 2006-192461 filed on Jul. 13, 2006.

BACKGROUND OF THE INVENTION

1. Field of the Invention

The present invention relates to an exhaust gas purification device of an internal combustion engine having a NOx catalyst.

2. Description of Related Art

An occlusion reduction NOx catalyst (LNT) occludes NOx in a lean condition and discharges the NOx after reducing the NOx with HC or CO in a rich condition. If a NOx occlusion amount increases, NOx occlusion performance is deteriorated. If the NOx occlusion performance is saturated, the function as the NOx catalyst is lost. Therefore, fuel as a reducing agent is supplied to the NOx catalyst by making a rich condition periodically. Thus, the NOx occlusion amount within the NOx catalyst is eliminated by reducing and releasing the occluded NOx. This processing is generally called as rich purge control.

Accumulation of a sulfur component contained in the fuel degrades the NOx occlusion performance of the occlusion reduction NOx catalyst. When a large amount of the sulfur component accumulates, a state satisfying a sulfur release condition (temperature $\geqq 600°$ C., air-fuel ratio $\leqq 14.5$) is made to release the sulfur component. This processing is generally called as recovery from sulfur poisoning. This processing is performed by estimating a degree of the degradation, for example, every 1000 km run. This processing causes fuel consumption aggravation and heat deterioration of a catalyst component because of elevated temperature. If the degradation degree of the NOx occlusion performance due to the accumulation of the sulfur component can be determined with sufficient accuracy, the recovery from sulfur poisoning can be performed when necessary. Accordingly, the frequency of performing the recovery from sulfur poisoning can be minimized. For this reason, an exact degradation determination technique of the NOx catalyst is desired.

For example, a method described in JP-A-2000-34946 compares a provable amount of the NOx occluded in the NOx catalyst (or amount indicative of its characteristic) at the time of start of the rich purge control with the amount of the NOx actually occluded (or amount indicative of its characteristic) in order to sense the performance degradation of the occlusion reduction NOx catalyst. The amount of the actually occluded NOx (actual NOx occlusion amount) is equivalent to the amount of the reducing agent consumed by the NOx catalyst while the rich purge control is performed once. Therefore, the actual NOx occlusion amount can be estimated by beforehand grasping a relationship between the fuel amount consumed as the reducing agent and the NOx amount, which can be reduced, through estimation of the fuel amount consumed as the reducing agent based on an air-fuel ratio sensed with an A/F sensor upstream of the NOx catalyst and an amount of fresh air (sensed with airflow meter or the like) supplied to the engine.

However, if the rich condition is made through combustion in a compression ignition internal combustion engine, the combustion becomes unstable in many cases. In such the cases, the HC component can vary or 1% or more of residual oxygen can be contained even in the rich condition. As a result, the output of the A/F sensor will shift. Since the fuel amount consumed in the reduction is estimated by using a signal of the A/F sensor, whose output has shifted, i.e., by using the air-fuel ratio information with low accuracy, an estimation error in the fuel amount consumed in the reduction enlarges. Accordingly, an estimation error of the actual NOx occlusion amount enlarges. As a result, accurate degradation determination of the NOx catalyst cannot be performed.

There is another method of obtaining the air-fuel ratio information. The method estimates the air-fuel ratio information based on the fuel injection amount calculated from an injection amount command value outputted to the injector and the fresh air amount. However, generally, the injector has a gain error and an offset error between a command injection amount corresponding to an injection amount command value and an actual injection amount. A variation in a period from an energization start to actual valve-opening of a nozzle is a component of the offset error, and a variation in a flow rate resistance of the nozzle is a component of the gain error. Therefore, it is difficult to estimate an exact air-fuel ratio from the fresh air amount measurement value and the injection amount command value. As a result, it is difficult to perform degradation determination of the NOx catalyst accurately.

SUMMARY OF THE INVENTION

It is an object of the present invention to realize accurate calculation of an amount of a reducing agent consumed by a NOx catalyst in rich purge control.

According to an aspect of the present invention, an exhaust gas purification device for an internal combustion engine senses an air-fuel ratio of exhaust gas flowing into a NOx catalyst with an A/F sensor and performs rich purge control of setting an injection amount command value such that the air-fuel ratio becomes rich in order to supply fuel for reduction to the NOx catalyst. The exhaust gas purification device calculates a total reducing agent amount consumed for the reduction during the rich purge control based on the air-fuel ratio as of the rich purge control and a fresh air amount as of the rich purge control. The exhaust gas purification device sets a specified air-fuel ratio state, in which the air-fuel ratio is controlled in a certain air-fuel ratio range enabling more precise measurement of the air-fuel ratio than in the rich purge control. The exhaust gas purification device corrects the value of the total reducing agent amount based on an injection amount command value difference, which is a difference between an injection amount command value in the rich purge control and the injection amount command value in the specified air-fuel ratio state, and the air-fuel ratio sensed with the A/F sensor in the specified air-fuel ratio state.

Thus, an offset error between a command injection amount corresponding to an injection amount command value and an actual injection amount can be canceled by using the injection amount command value difference in the form of the difference. Moreover, a gain error can be also significantly reduced because the command injection amount difference corresponding to the injection amount command value difference is much smaller than the actual injection amount (e.g., command injection amount difference is approximately one tenth of actual injection amount). Therefore, the injection amount command value difference can be regarded as high-precision information.

Since the total reducing agent amount is calculated by a total reducing agent amount calculation device using the air-fuel ratio information with low precision, the estimation error enlarges. However, the value of the total reducing agent amount is corrected based on the high-precision injection amount command value difference information and the high-precision air-fuel ratio information. Accordingly, the amount of the reducing agent consumed in the NOx catalyst in the rich purge control can be calculated correctly. As a result, exact presumption of the actual NOx occlusion amount and exact deterioration determination of the NOx catalyst can be performed.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Figure 1:
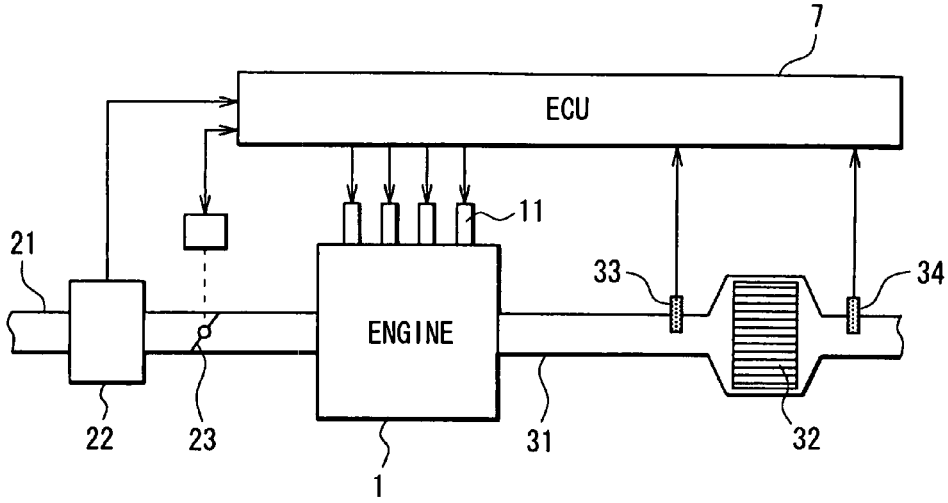
FIG. 1 is a schematic diagram showing an internal combustion engine having an exhaust gas purification device according to a first embodiment of the present invention.

Referring to FIG. 1, an internal combustion engine having an exhaust gas purification device according to a first embodiment of the present invention is illustrated. As shown in FIG. 1, injectors 11 are mounted to a main body section of the internal combustion engine 1 (in more detail, compression ignition internal combustion engine). The injectors 11 are connected to a common rail (not shown) that accumulates high-pressure fuel. The injectors 11 inject the high-pressure fuel, which is supplied from the common rail, into cylinders of the engine 1.

An airflow meter 22 as a fresh air amount sensing device that senses an amount of fresh air supplied to the engine 1 and an intake throttle 23 that is arranged downstream of the airflow meter 22 for regulating the amount of the fresh air are provided in an intake pipe 21 of the engine 1.

A NOx catalyst 32 (LNT) is provided in an exhaust pipe 31 of the engine 1. The NOx catalyst occludes NOx contained in exhaust gas when an air-fuel ratio is lean and reduces and releases the NOx when the air-fuel ratio is rich. A first A/F sensor 33 for sensing the air-fuel ratio of the exhaust gas flowing into the NOx catalyst 32 is provided upstream of the NOx catalyst 32 in the exhaust pipe 31. A second A/F sensor 34 for sensing the air-fuel ratio of the exhaust gas flowing out of the NOx catalyst 32 is provided downstream of the NOx catalyst 32 in the exhaust pipe 31.

The outputs of the various sensors mentioned above are inputted into an ECU 7. The ECU 7 has a microcomputer consisting of a CPU, a ROM, a RAM, an EEPROM and the like (not shown). The ECU 7 performs predetermined computation based on the signals inputted from the sensors and controls operations of various components of the engine 1. For example, the ECU 7 calculates a command injection amount based on a load and rotation speed of the engine 1 and calculates an injection amount command value corresponding to an injector drive period from the command injection amount. Then, the ECU 7 outputs an injection amount command value signal to the injector 11.

Figure 2:
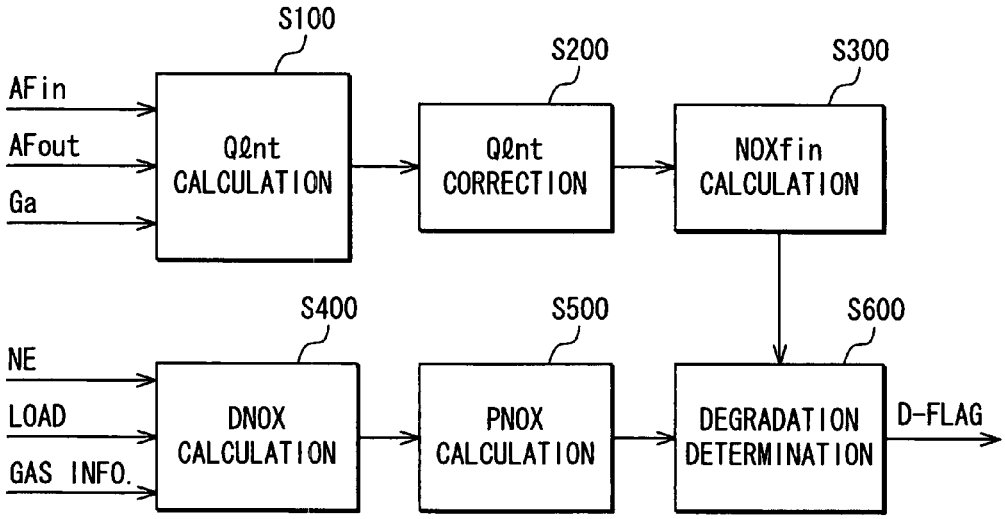
FIG. 2 is a block diagram showing a flow of degradation determination processing of a NOx catalyst according to the first embodiment.

Next, degradation determination processing of the NOx catalyst 32 performed by the ECU 7 in the exhaust gas purification device will be explained. FIG. 2 is a diagram showing a flow of the degradation determination processing of the NOx catalyst 32. As shown in FIG. 2, a total reducing agent amount QInt as the sum of the fuel consumed for the reduction while the rich purge control is performed once is calculated (Step S100) based on the fresh air amount Ga sensed with the airflow meter 22 and the air-fuel ratios AFin, AFout sensed with the first and second A/F sensors 33, 34 during the rich purge control. The value of the total reducing agent amount QInt is corrected (Step S200). Based on the corrected value of the total reducing agent amount QInt, an amount of the NOx that would have been actually occluded in the NOx catalyst 32 (actual NOx occlusion amount NOXfin) at the start of the rich purge control is estimated (Step S300).

An amount of the NOx discharged from the engine 1 (NOx discharge amount DNOX) is estimated based on the load, the rotation speed NE and gas information (fresh air amount Ga, EGR rate and the like) of the engine 1 (Step S400). An amount of the NOx that would have been occluded in the NOx catalyst 32 at the start of the rich purge control (prediction NOx occlusion amount PNOX) is estimated based on the estimated NOx discharge amount DNOX and a beforehand-grasped characteristic of the catalyst before the degradation (Step S500). The degree of the degradation of the NOx catalyst 32 is determined based on a difference between the actual NOx occlusion amount NOXfin calculated at Step S300 and the prediction NOx occlusion amount PNOX calculated at Step S500 and a degradation determination flag D-FLAG is raised or lowered in accordance with the result of the degradation determination (Step S600).

Since Steps S400-S600 among Steps S100-S600 are common knowledge, only Steps S100-S300 will be explained in detail hereafter.

Figure 3:
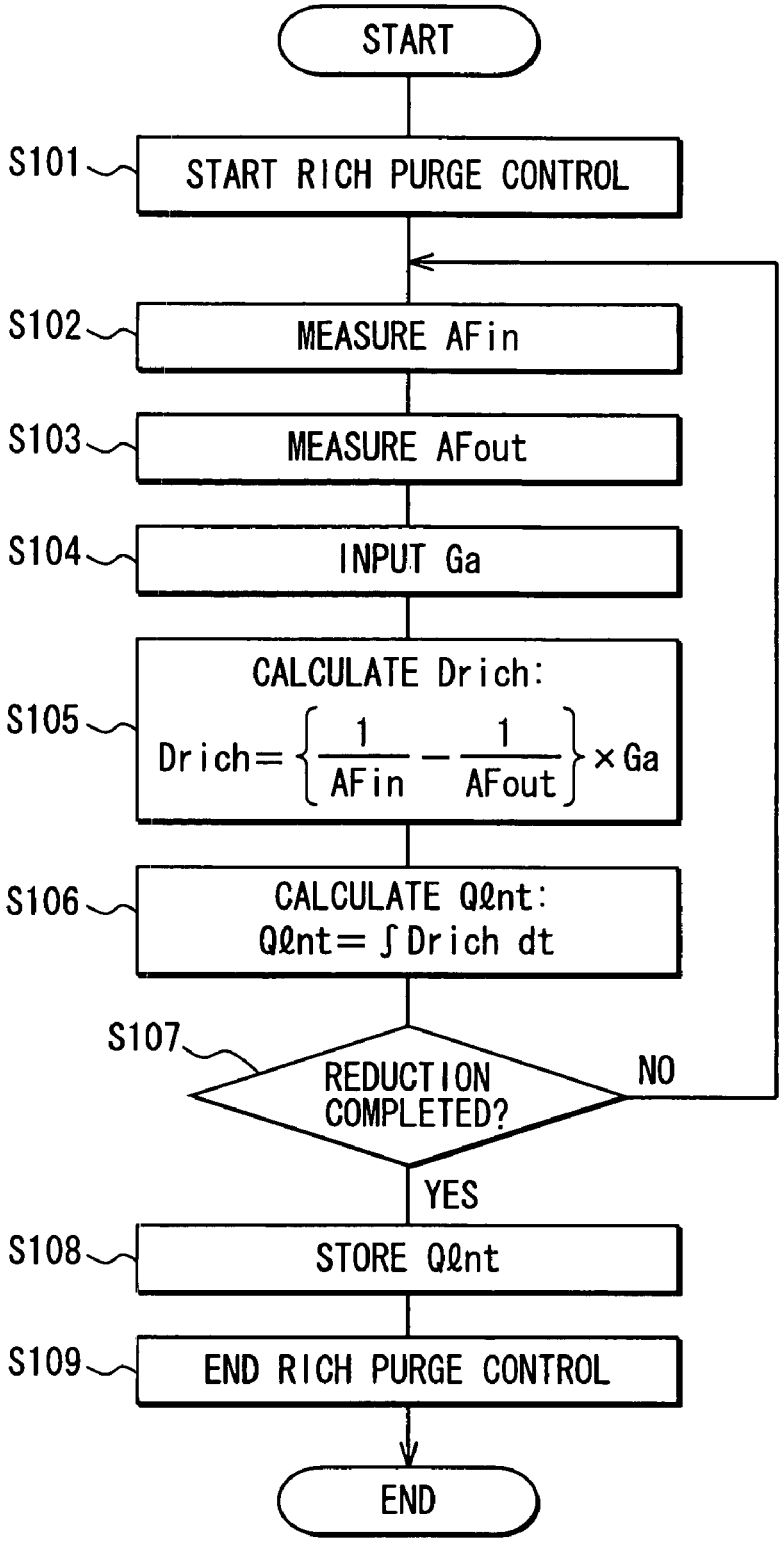
FIG. 3 is a flowchart showing total reducing agent amount calculation processing according to the first embodiment.
Figure 4:
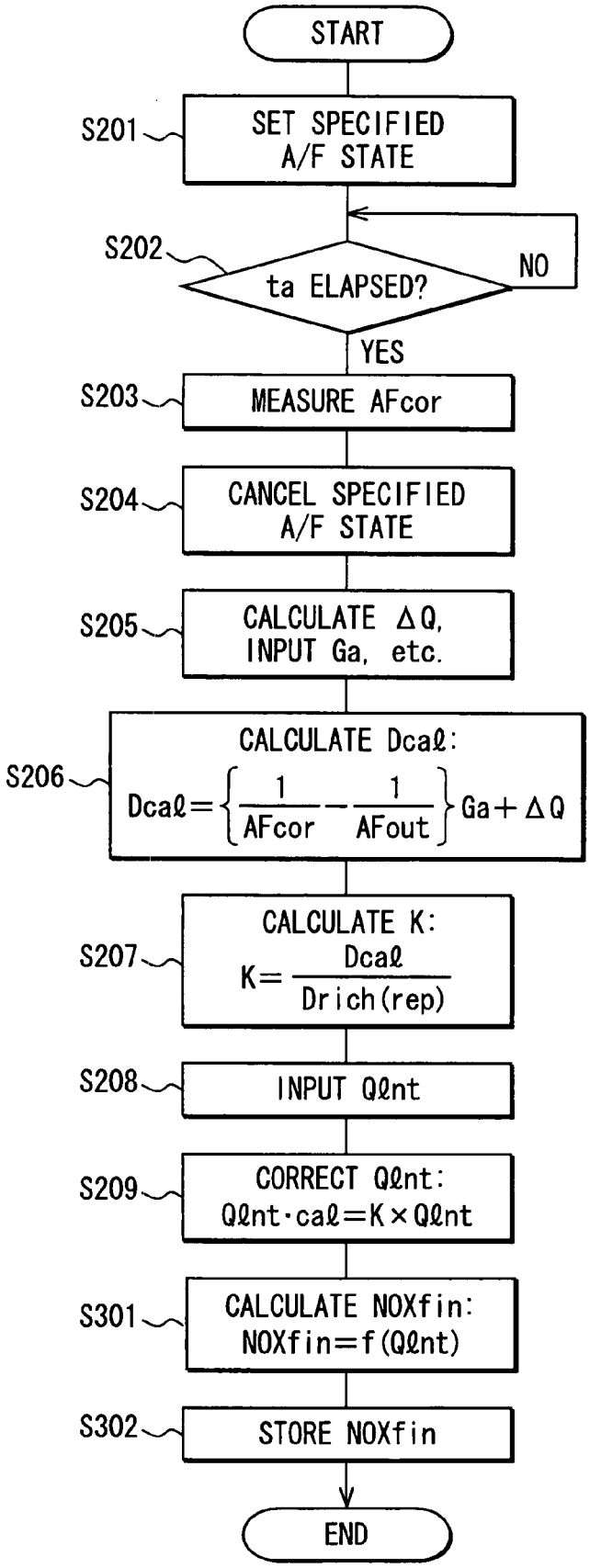
FIG. 4 is a flowchart showing total reducing agent amount correction processing and actual NOx occlusion amount calculation processing according to the first embodiment.
Figure 5:
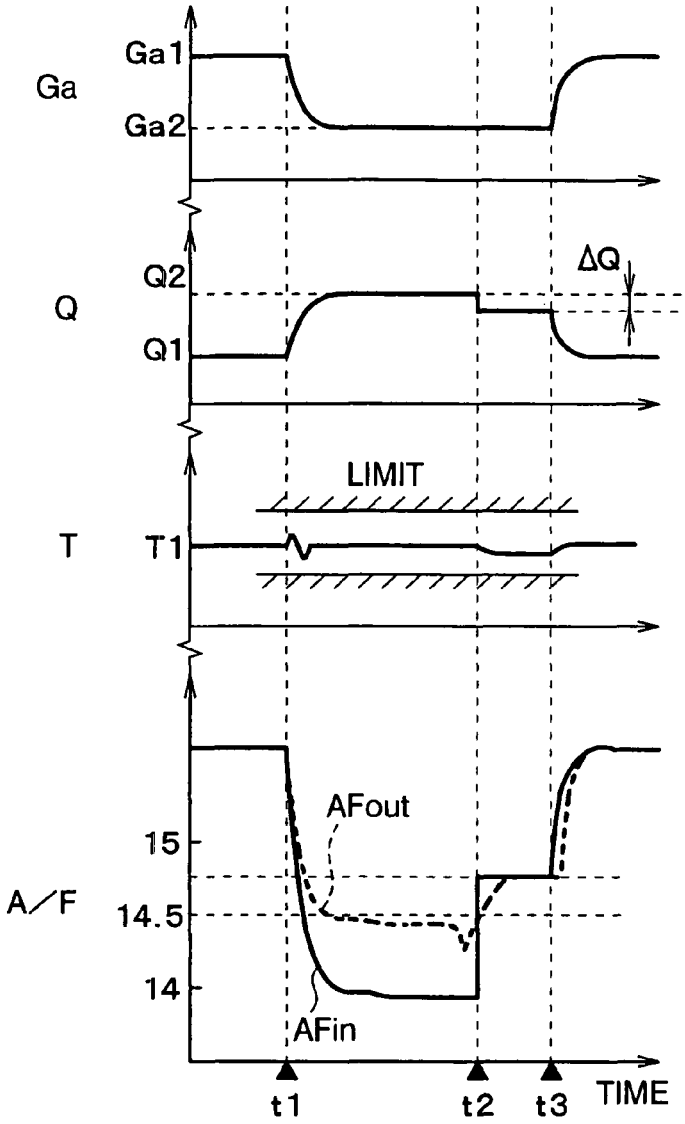
FIG. 5 is a time chart showing an operation example as of the processing of FIG. 2.

FIG. 3 is a flowchart showing a detail of the total reducing agent amount calculation processing of Step S100. FIG. 4 is a flowchart showing a detail of the total reducing agent amount correction processing of Step S200 and the actual NOx occlusion amount calculation processing of Step S300. FIG. 5 is a time chart showing an operation example in the progress of the processing of Steps S100-S300.

First, the total reducing agent amount calculation processing of Step S100 will be explained in detail in reference to FIGS. 3 and 5. This processing is performed in a constant computation cycle (for example, 16 ms). If an estimation NOx occlusion amount of the NOx catalyst 32 calculated by a well-known method reaches a specified value, the injection amount command value is set to make the air-fuel ratio rich to start the rich purge control, and the injection amount command value at this time is stored in an internal memory (Step S101). At this time, in order to change the state from a normal state to the rich purge control state, the fresh air amount Ga is reduced from a value Ga1 to a value Ga2 and the fuel injection amount Q is increased from a value Q1 to a value Q2 at time t1 shown in FIG. 5. This control of the fresh air amount Ga is realized by closing the intake throttle 23. In order to conform the torque T in the rich purge control state to the torque T1 in the normal state, combustion start timing is controlled by changing the fuel injection timing. In FIG. 5, LIMIT represents a drivability limit.

After the rich purge control is started, the air-fuel ratio AFin of the exhaust gas flowing into the NOx catalyst 32 (inflow air-fuel ratio AFin) is sensed with the first A/F sensor 33 and the inflow air-fuel ratio AFin at this time is stored in the internal memory (Step S102). Then, the air-fuel ratio AFout of the exhaust gas flowing out of the NOx catalyst 32 (outflow air-fuel ratio AFout) is sensed with the second A/F sensor 34, and the outflow air-fuel ratio AFout at this time is stored in the internal memory (Step S103). The fresh air amount Ga supplied to the engine 1 is sensed with the airflow meter 22, and the fresh air amount Ga at this time is stored in the internal memory (Step S104).

As shown in FIG. 5, the inflow air-fuel ratio AFin enters a rich area during the rich purge control. The outflow air-fuel ratio AFout substantially exhibits the stoichiometric value (approximately 14.5) while the NOx occluded in the NOx catalyst 32 is reduced. The outflow air-fuel ratio AFout enters the rich area if the reduction is completed and the fuel as the reducing agent passes through the NOx catalyst 32.

The outflow air-fuel ratio AFout takes a leaner value than the inflow air-fuel ratio AFin while the reduction of the NOx is performed because the fuel is consumed for the reduction within the NOx catalyst 32. Therefore, the amount of the fuel consumed for the reduction in the NOx catalyst 32 can be calculated from an air-fuel ratio difference and the fresh air amount Ga.

An instant reducing agent amount Drich is calculated by following Expression (1), and the instant reducing agent amount Drich is stored in the internal memory (Step S105 of FIG. 3). The instant reducing agent amount Drich is the amount of the fuel consumed for the reduction within the NOx catalyst 32 per computation cycle.

$$Drich=(1/AFin-1/AFout)\times Ga \qquad \text{Expression (1):}$$

While the reduction of the NOx is performed, the outflow air-fuel ratio AFout substantially exhibits the stoichiometric value (approximately 14.5). Therefore, an air-fuel ratio of 14.5 may be used in Expression (1) in place of the value AFout sensed with the second A/F sensor 34.

After Step S105, the total reducing agent amount QInt as the sum of the fuel consumed for the reduction during the rich purge control is calculated by following Expression (2) (Step S106). The total reducing agent amount QInt is calculated by integrating the instant reducing agent amount Drich until the reduction of the NOx occluded in the NOx catalyst 32 is completed through the rich purge control (Step S107: YES).

$$QInt=\int Drich\, dt \qquad \text{Expression (2):}$$

The completion of the reduction of the NOx occluded in the NOx catalyst 32 through the rich purge control is determined based on the outflow air-fuel ratio AFout at Step S107. It is determined that the reduction of the NOx is completed when the outflow air-fuel ratio AFout becomes equal to or lower than a specified value (for example, 14.3). That is, it is determined that the reduction of the NOx is completed when the reduction of the NOx occluded within the NOx catalyst 32 is completed and the reducing agent passes through the NOx catalyst 32.

The determination at Step S107 is performed based on the outflow air-fuel ratio AFout sensed with the second A/F sensor 34. Alternatively, an oxygen sensor having a function to determine whether the condition is a lean condition or a rich condition may be installed downstream of the NOx catalyst 32, and the determination at Step S107 may be performed based on the information sensed by the oxygen sensor.

When Step S107 is NO (i.e., when reduction of NOx is not completed), the processing of Steps S102 to S106 is repeated. When the reduction of the NOx is completed and Step S107 becomes YES, the total reducing agent amount QInt calculated at Step S106 is stored in the internal memory (Step S108), and the rich purge control is ended (Step S109).

Thus, in the total reducing agent amount calculation processing, the rich purge control is performed to reduce and release the NOx occluded in the NOx catalyst 32, and the total reducing agent amount QInt as the total amount of the fuel consumed for the reduction during the rich purge control is calculated.

Figure 6:
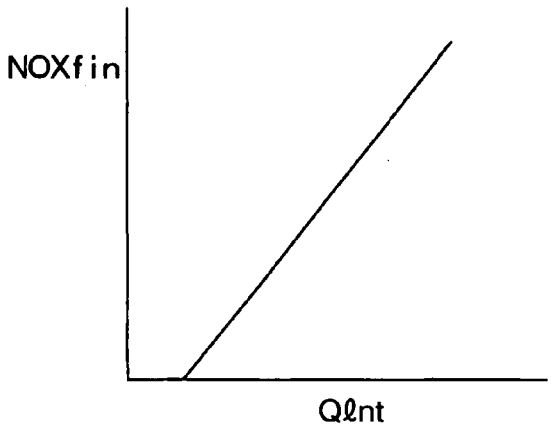
FIG. 6 is a diagram showing a relationship between a total reducing agent amount and a NOx occlusion amount.

Ideally, the total reducing agent amount QInt calculated at Step S106 should have a substantially linear relationship with the NOx amount NOXfin (NOx occlusion amount NOXfin) that has been occluded in the NOx catalyst 32 until the rich purge control. Therefore, if the relationship is examined beforehand, the NOx occlusion amount NOXfin can be calculated from the total reducing agent amount QInt. FIG. 6 shows the relationship between the total reducing agent amount QInt and the NOx occlusion amount NOXfin. An x-intercept arises in the graph of FIG. 6 because the NOx catalyst 32 has an oxygen storage and part of the reducing agent is consumed.

Figure 7:
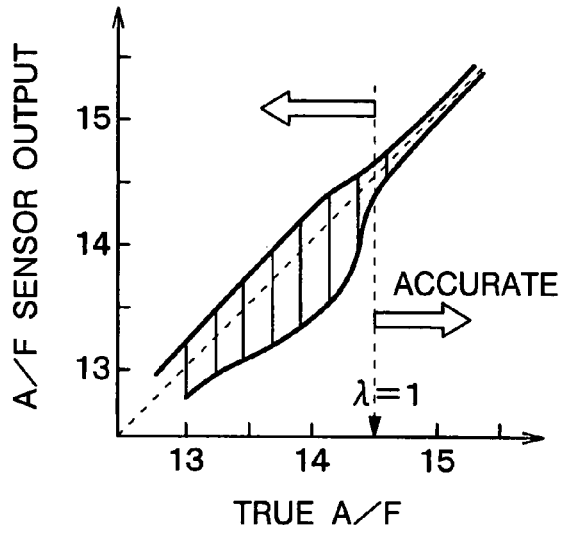
FIG. 7 is a diagram showing a degree of a variation in an output of an A/F sensor with respect to a true air-fuel ratio.

However, if the rich condition is made by the combustion in the compression ignition internal combustion engine 1, the outputs of the A/F sensors 33, 34 shift. FIG. 7 shows the degree of the variation of the outputs of the A/F sensors 33, 34 with respect to the true air-fuel ratio (true A/F). The variation in the outputs of the A/F sensors 33, 34 is large in a range of the air-fuel ratio less than 14.5, specifically, in a range of the air-fuel ratio near 14.

Figure 8:
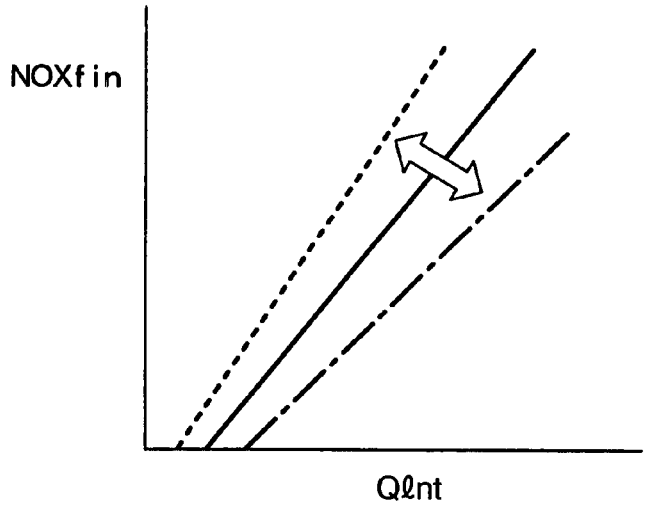
FIG. 8 is a diagram showing a relationship between the total reducing agent amount and the NOx occlusion amount.

Therefore, the inflow air-fuel ratio AFin in the rich purge control is inaccurate air-fuel ratio information. A large estimation error is caused in the total reducing agent amount QInt estimated using the information. As a result, the relationship between the total reducing agent amount QInt and the NOx occlusion amount NOXfin varies as shown by an arrow mark in FIG. 8. The characteristic differs from the characteristic of the conversion formula examined beforehand, so the NOx occlusion amount NOXfin cannot be estimated accurately.

Figure 9:
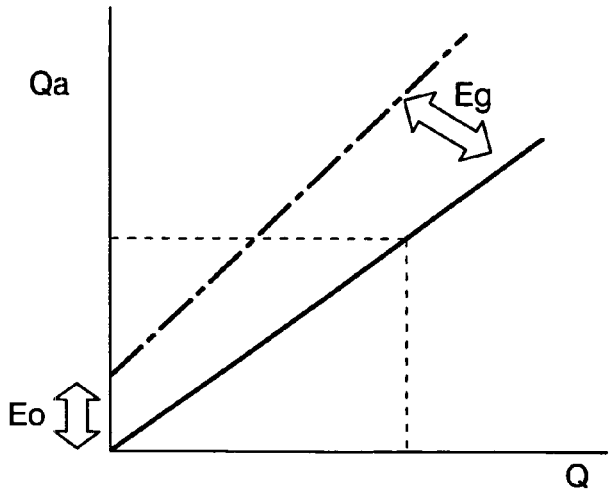
FIG. 9 is a diagram showing a relationship between a command injection amount and an actual injection amount.

The total reducing agent amount QInt can be estimated with sufficient accuracy if the degree of the air-fuel ratio of the gas supplied to the NOx catalyst 32 in the rich purge control is acknowledged. As described above, there is a method of obtaining the air-fuel ratio information by estimating the air-fuel information based on the command injection amount, which is calculated from the injection amount command value of the injector 11, and the fresh air amount. However, the gain error Eg and the offset error Eo exist between the command injection amount Q and the actual injection amount Qa as shown in FIG. 9. Therefore, it is difficult to estimate the exact air-fuel ratio.

Attention is paid to the characteristics of the A/F sensors 33, 34 with respect to the diesel engine exhaust gas. The air-fuel ratio is decided by the HC component, the CO component and the residual oxygen component. In the gasoline engine, the CO component is dominant and the output of the A/F sensor 34 is stabilized at the air-fuel ratio less than 14.5. In the compression ignition internal combustion engine, the combustion is relatively unstable and considerable amounts of the HC component, the CO component and the residual oxygen component exist, and the HC component includes components varying from the methane as one of low-molecule components to high-molecule components at the air-fuel ratio less than 14.5. As a result, the outputs of the A/F sensors 33, 34 are not stabilized. At the air-fuel ratio of 14.5 or higher, the remaining oxygen concentration is substantially dominant and the combustion is stabilized, so the gas composition of the HC component is also stabilized. Therefore, as shown in FIG. 7, the outputs of the A/F sensors 33, 34 are also stabilized.

Therefore, in the present embodiment, in the total reducing agent amount correction processing (Step S200 of FIG. 2), a state of the air-fuel ratio range of 14.5 or higher (specified air-fuel ratio state), in which the outputs of the A/F sensors 33, 34 are stabilized, is made. Thus, the highly accurate air-fuel ratio is obtained and the approximate amount of the reducing agent actually supplied in the rich purge control state is estimated, and the total reducing agent amount QInt calculated at Step S106 is corrected. In the actual NOx occlusion amount calculation processing (Step S300 of FIG. 2), the NOx occlusion amount NOXfin is calculated based on the corrected total reducing agent amount QInt·cal calculated trough the total reducing agent amount correction processing.

Next, the total reducing agent amount correction processing and the actual NOx occlusion amount calculation processing will be explained in detail in reference to FIGS. 4 and 5. First, the specified air-fuel ratio state is set at time t2 (Step S201). For example, the fresh air amount Ga is conformed to the fresh air amount Ga2 used in the rich purge control. Thus, a measuring error of the fresh air amount Ga can be cancelled by conforming the fresh air amount in the specified air-fuel ratio state to the fresh air amount Ga2 used in the rich purge control. The fuel injection amount is reduced until the air-fuel ratio becomes approximately 15. At Step S201, the injection amount command value at this time is stored in the internal memory.

Then, it is determined whether a predetermined time ta (for example, 5 seconds) has passed after setting the specified air-fuel ratio state at time t2 (Step S202). If the predetermined time ta has not passed (Step S202: NO), the determination at Step S202 is repeated. If the predetermined time ta passes (Step S202: YES), it is estimated that a condition stabilizing the outputs of the A/F sensors 33, 34 is made, and the processing proceeds to Step S203.

An inflow air-fuel ratio AFcor in the specified air-fuel ratio state is sensed with the first A/F sensor 33 (Step S203). Then, the specified air-fuel ratio state is canceled at time t3, and the normal state is resumed (Step S204).

The inflow air-fuel ratio AFcor in the specified air-fuel ratio state is expressed by following Expression (3). The inflow air-fuel ratio AFin in the rich purge control is expressed by following Expression (4). Expression (5) is derived from Expressions (3) and (4). In Expressions (3) to (5), Q represents the command injection amount in the rich purge control and ΔQ represents the difference between the command injection amount in the rich purge control and the command injection amount in the specified air-fuel ratio state.

$$AF\text{cor}=Ga/(Q-\Delta Q) \quad \text{Expression (3):}$$

$$AF\text{in}=Ga/Q \quad \text{Expression (4):}$$

$$AF\text{cor}\times(Q-\Delta Q)/Q=AF\text{in} \quad \text{Expression (5):}$$

The true instant reducing agent amount Dcal in the rich purge control can be calculated by following Expression (6) derived from Expression (1), which calculates the instant reducing agent amount Drich, and Expression (5).

$$D\text{cal}=(1/AF\text{cor}-1/AF\text{out})\times Ga+\Delta Q \quad \text{Expression (6):}$$

At Step S205, information necessary for calculating the true instant reducing agent amount Dcal and a total reducing agent amount correction factor K is obtained. For example, the data stored in the internal memory at Steps S101 to S105 (i.e., injection amount command value in rich purge control, inflow air-fuel ratio AFin, outflow air-fuel ratio AFout, fresh air amount Ga and instant reducing agent amount Drich) are read, and the injection amount command value in the specified air-fuel ratio state stored in the internal memory at Step S201 is read. At Step S205, the command injection amount difference ΔQ is calculated based on the injection amount command value in the rich purge control and the injection amount command value in the specified air-fuel ratio state. At Step S206, the true instant reducing agent amount Dcal is calculated based on Expression (6).

The true instant reducing agent amount Dcal is used to calculate the total reducing agent amount correction factor K and does not require high accuracy. The outflow air-fuel ratio AFout at this time is about 14.5 (air-fuel ratio at the time when excess air ratio λ is 1). Therefore, when calculating the true instant reducing agent amount Dcal by Expression (6), a value of 14.5 may substitute as the inflow air-fuel ratio AFcor.

Next, at Step S207, the total reducing agent amount correction factor K is calculated from the true instant reducing agent amount Dcal calculated at Step S206 and a representative value Drich(rep) of the instant reducing agent amount Drich calculated at Step S105. The correction factor K is calculated by dividing the true instant reducing agent amount Dcal by the representative value Drich(rep) of the instant reducing agent amount Drich.

When the period of time of the rich purge control is long (for example, 5 seconds or longer), the average of the instant reducing agent amount Drich in the period is used as the representative value Drich(rep) of the instant reducing agent amount Drich. The value of the inflow air-fuel ratio AFin deviates toward a lean side compared to the actual value due to the response delay of the first A/F sensor 33 in the early stage of the rich purge control, and there is a tendency that the instant reducing agent amount Drich is calculated less. Therefore, when the period of time of the rich purge control is short, the maximum value of the instant reducing agent amount Drich in the period is used as the representative value Drich (rep) of the instant reducing agent amount Drich. Thus, the instant reducing agent amount Drich with the reduced error can be calculated.

Then, the total reducing agent amount QInt stored in the internal memory at Step S108 is read (Step S208), and the corrected total reducing agent amount QInt·cal is calculated by following Expression (7) (Step S209). Thus, when the true instant reducing agent amount Dcal is larger than the representative value Drich(rep) of the instant reducing agent amount Drich, the value of the total reducing agent amount QInt is corrected to increase. When the true instant reducing agent amount Dcal is smaller than the representative value Drich(rep) of the instant reducing agent amount Drich, the value of the total reducing agent amount QInt is corrected to decrease.

$$Q\text{Int}\cdot\text{cal}=K\times Q\text{Int} \quad \text{Expression (7):}$$

Then, the NOx occlusion amount NOXfin is calculated based on the corrected total reducing agent amount QInt·cal calculated at Step S209 (Step S301), and the calculated NOx occlusion amount NOXfin is stored (Step S302). At Step S301, for example, a relationship between the total reducing agent amount and the NOx occlusion amount is examined and a conversion equation is created. The conversion equation is beforehand stored in the internal memory. The NOx occlusion amount NOXfin is calculated from the corrected total reducing agent amount QInt·cal using the conversion equation. Thus, the corrected total reducing agent amount QInt·cal with the reduced estimation error can be calculated through the total reducing agent amount correction processing (Steps S201 to S209).

The estimation error decreases for the following reasons. That is, the offset error between the command injection amount and the actual injection amount is canceled by using the command injection amount difference ΔQ in the form of the difference. Since the command injection amount difference ΔQ is much smaller than the actual injection amount (e.g., command injection amount difference ΔQ is one tenth of actual injection amount), the gain error is also extremely small. Therefore, the command injection amount difference ΔQ can be regarded as highly precise information. The inflow air-fuel ratio AFcor in the specified air-fuel ratio state is also highly precise information. Therefore, the amount of the reducing agent consumed by the NOx catalyst 32 in the rich purge control can be precisely calculated by correcting the value of the total reducing agent amount QInt based on the highly precise information.

In the actual NOx occlusion amount calculation processing (Steps S301-S302), the NOx occlusion amount NOXfin can be precisely estimated based on the corrected total reducing agent amount QInt·cal with the reduced estimation error.

In the present embodiment, the total reducing agent amount correction processing is performed consecutively and immediately after the completion of the total reducing agent amount calculation processing. That is, the specified air-fuel ratio state is set consecutively and immediately after the completion of the rich purge control. Therefore, influences of the degradation error of the injector 11 or the airflow meter 22 or environmental errors can be reduced. As a result, the highly precise command injection amount difference information and air-fuel ratio information can be acquired. Moreover, the period of calculating the total reducing agent amount can be shortened. The rich purge control precedes the specified air-fuel ratio state. Accordingly, a problem caused when the operational state suddenly changes so that the low air-fuel ratio cannot be maintained is avoidable. For example, a problem that the rich purge control cannot be performed or a problem that an execution time of the rich purge control shortens are avoidable.

Figure 10:
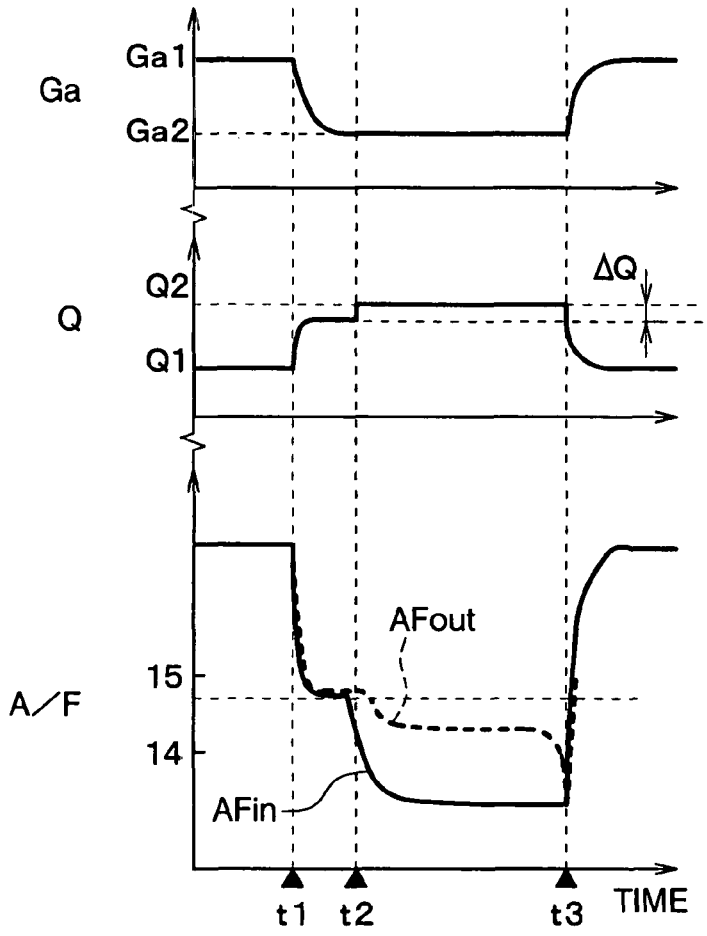
FIG. 10 is a time chart showing an operation example of an exhaust gas purification device according to a second embodiment of the present invention.

Next, an exhaust gas purification device according to a second embodiment of the present invention will be explained in reference to drawings. FIG. 10 is a time chart showing an operation example of the exhaust gas purification device according to the second embodiment.

In the first embodiment, the specified air-fuel ratio state is set consecutively and immediately after the completion of the rich purge control. Alternatively, the specified air-fuel ratio state may be set immediately before the rich purge control as in the present embodiment. That is, as shown in FIG. 10, if the estimated NOx occlusion amount of the NOx catalyst 32 reaches a specified value, the specified air-fuel ratio state is set at time t1 and necessary information is acquired. Subsequently, the rich condition is made from time t2 to start the rich purge control, and necessary information is acquired. When it is determined that the reduction of the NOx occluded in the NOx catalyst 32 is completed (time t3), the rich purge control is ended and the normal state is resumed. Then, the NOx occlusion amount NOXfin is estimated by performing predetermined computation based on the acquired information.

In the above-described embodiments, the total reducing agent amount QInt is calculated in real time during the rich purge control. Alternatively, the total reducing agent amount QInt may be calculated based on the measurement data obtained during the rich purge control after the rich purge control is completed.

In the above-described embodiments, the air-fuel ratio in the specified air-fuel ratio state is set at approximately 15. The air-fuel ratio of 14.2 or higher is desirable because the range, in which the outputs of the A/F sensors 33, 34 are stabilized, starts from the air-fuel ratio of approximately 14.2. The air-fuel ratio of 14.5 or higher is still more desirable.

Figure 11:
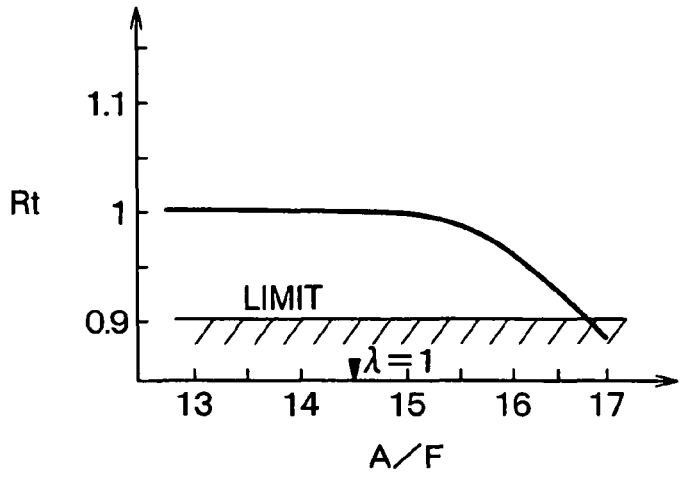
FIG. 11 is a diagram showing a relationship between an air-fuel ratio and torque of an internal combustion engine according to the second embodiment.

As shown in FIG. 11, the torque of the engine 1 is substantially decided by the fresh air amount Ga in the range of the air-fuel ratio A/F equal to or less than 15. Rt in FIG. 11 represents an engine torque ratio. The torque is decided by the injection amount when the air-fuel ratio is 17 or higher. The torque takes a middle characteristic in a transitional range of the air-fuel ratio between 15 and 17. The torque in the case of the air-fuel ratio of 17 is approximately 90% of the torque in the case of the air-fuel ratio of 15 or lower. The decrease of the torque at the air-fuel ratio of approximately 16 compared to the decrease at the air-fuel ratio of 15 or lower is small. Therefore, in order to prevent discomfort to a driver due to arising of torque shock when the state shifts to the specified air-fuel ratio state, the air-fuel ratio in the specified air-fuel ratio state should be preferably 17 or lower, or more preferably, 16.0 or lower. LIMIT in FIG. 11 represents a torque shock limit (drivability limit).

An oxidation catalyst having an oxidation function may be located upstream of the first A/F sensor 33 in the exhaust pipe 31 in the exhaust gas purification device of the above-described embodiments. The oxidation catalyst causes reaction between the fuel and the oxygen at the air-fuel ratio of 14.5 or higher. Therefore, the unburned HC component is consumed. Thus, the accuracy of the first A/F sensor 33 is improved at the air-fuel ratio of 14.5 or higher. As a result, the accuracy of the correction method improves more.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An exhaust gas purification device for an internal combustion engine, the exhaust gas purification device comprising:

an injector that injects fuel of an amount corresponding to an injection amount command value into a cylinder of the engine;

a NOx catalyst provided in an exhaust system of the engine for occluding nitrogen oxides when an air-fuel ratio is lean and for reducing and releasing the occluded nitrogen oxides when the air-fuel ratio is rich;

an A/F sensor provided upstream of the NOx catalyst in the exhaust system for sensing the air-fuel ratio;

a fresh air amount sensor that senses an amount of a fresh air supplied to the engine;

a rich purge controller that performs rich purge control of setting the injection amount command value to make the air-fuel ratio rich, whereby supplying the fuel for reduction to the NOx catalyst;

a total reducing agent amount calculation device that calculates a total reducing agent amount as a sum of the fuel consumed for the reduction in the rich purge control based on the air-fuel ratio as of the rich purge control sensed with the A/F sensor and the fresh air amount as of the rich purge control sensed with the fresh air amount sensor;

a state setting device that sets a specified air-fuel ratio state, in which the air-fuel ratio is controlled in a certain air-fuel ratio range enabling more precise measurement of the air-fuel ratio than in the rich purge control; and a total reducing agent amount correction device that corrects a value of the total reducing agent amount based on an injection amount command value difference, which is a difference between the injection amount command value in the rich purge control and the injection amount command value in the specified air-fuel ratio state, and the air-fuel ratio in the specified air-fuel ratio state sensed with the A/F sensor.

2. The exhaust gas purification device as in claim 1, wherein the total reducing agent amount correction device calculates a correction factor for correcting the value of the total reducing agent amount by estimating a supply state of the fuel for the reduction in the rich purge control based on the injection amount command value difference and the air-fuel ratio in the specified air-fuel ratio state.

3. The exhaust gas purification device as in claim 1, wherein the state setting device sets the specified air-fuel ratio state consecutively before or after the rich purge control.

4. The exhaust gas purification device as in claim 1, wherein the state setting device sets the specified air-fuel ratio state consecutively and immediately after the rich purge control.

5. The exhaust gas purification device as in claim 1, wherein the fresh air amount as of the rich purge control and the fresh air amount in the specified air-fuel ratio state are equalized.

6. The exhaust gas purification device as in claim 1, further comprising:

a NOx occlusion amount calculation device that estimates the amount of the nitrogen oxides occluded in the NOx catalyst as of start timing of the rich purge control based on the value of the total reducing agent amount corrected by the total reducing agent amount correction device.

7. The exhaust gas purification device as in claim 1, wherein the total reducing agent amount calculation device calculates a first instant reducing agent amount, which is an amount of the fuel consumed for the reduction within a predetermined period in the rich purge control, based on the air-fuel ratio as of the rich purge control and the fresh air amount as of the rich purge control and calculates the total reducing agent amount by integrating the first instant reducing agent amount, the total reducing agent amount correction device estimates a second instant reducing agent amount, which is the amount of the fuel consumed for the reduction within the predetermined period in the rich purge control, based on the injection amount command value difference and the air-fuel ratio in the specified air-fuel ratio state, and the total reducing agent amount correction device performs the correction of increasing the value of the total reducing agent amount when the second instant reducing agent amount is greater than the first instant reducing agent amount and performs the correction of decreasing the value of the total reducing agent amount when the second instant reducing agent amount is smaller than the first instant reducing agent amount.

8. The exhaust gas purification device as in claim 3, wherein the total reducing agent amount calculation device calculates an average of a plurality of instant reducing agent amounts, which are calculated during the rich purge control, as the first instant reducing agent amount.

9. The exhaust gas purification device as in claim 7, wherein the total reducing agent amount calculation device calculates a maximum value among a plurality of instant reducing agent amounts, which are calculated during the rich purge control, as the first instant reducing agent amount.

10. The exhaust gas purification device as in claim 7, wherein the total reducing agent amount correction device uses an average of a plurality of instant reducing agent amounts, which are calculated during the rich purge control, as the first instant reducing agent amount when an execution time of the rich purge control is equal to or longer than a specified time and uses a maximum value among a plurality of instant reducing agent amounts, which are calculated during the rich purge control, as the first instant reducing agent amount when the execution time of the rich purge control is shorter than the specified time.

11. The exhaust gas purification device as in claim 1, wherein the state setting device controls the air-fuel ratio in a range from 14.2 to 17.0 when the specified air-fuel ratio state is set.

12. The exhaust gas purification device as in claim 11, wherein the state setting device controls the air-fuel ratio in a range from 14.5 to 16.0 when the specified air-fuel ratio state is set.

* * * * *